US005402137A

United States Patent [19]

Ramanujam et al.

[11] Patent Number: 5,402,137

[45] Date of Patent: Mar. 28, 1995

[54] EQUALIZED SHAPED REFLECTOR ANTENNA SYSTEM AND TECHNIQUE FOR EQUALIZING SAME

[75] Inventors: Parthasarathy Ramanujam, Redondo Beach; Alan R. Keith, Fullerton; Robert T. Clark, Buena Park, all of Calif.

[73] Assignee: Hughes Aircraft Company, Los Angeles, Calif.

[21] Appl. No.: 212,677

[22] Filed: Mar. 11, 1994

Related U.S. Application Data

[63] Continuation of Ser. No. 946,122, Sep. 17, 1992, abandoned.

[51] Int. Cl.[6] ..... H01Q 19/14

[52] U.S. Cl. ..... 343/781 P; 343/781 CA; 343/DIG. 2

[58] Field of Search ..... 363/781 P, 781 CA, 781 R, 363/DIG. 2, 779, 834, 836, 914; H01Q 19/14

[56] References Cited

U.S. PATENT DOCUMENTS

| | | | |
|---|---|---|---|
| 3,392,397 | 7/1968 | Schwartz | 343/781 CA |
| 4,482,897 | 1/1984 | Dragone et al. | 343/781 P |
| 4,573,051 | 2/1986 | Farina | 343/781 P |
| 4,823,143 | 4/1989 | Bockrath | 343/781 P |

*Primary Examiner*—Donald Hajec
*Assistant Examiner*—Hoanganh Le
*Attorney, Agent, or Firm*—Gordon R. Lindeen, III; William J. Streeter; Wanda K. Denson-Low

[57] ABSTRACT

Equalized offset fed east and west shaped reflectors (12) and (14) and technique for producing the same are provided herein. A first shaped reflector (12) has a first shaped reflective surface (3) formed to provide a first shaped beam radiation pattern (22). Dimensional deviations such as deviations (X) and (Y) are measured between the first shaped reflective surface (13) and a parent surface (30). A second shaped reflector (14) is formed with a shaped reflective surface (15) which has dimensional deviations superimposed on the other side of the parent surface (30). The second shaped reflector (12) is rotated 180 degrees relative to the first shaped reflector (14). The first and second shaped reflectors (12) and (14) are then placed in a configuration opposite one another and have shaped beam radiation patterns (22) and (24) which are substantially equal to one another. In addition, feed horns (18) and (20) are operatively coupled to the first and second shaped reflective surfaces (13) and (15) respectively.

10 Claims, 4 Drawing Sheets

EQUALIZED SHAPED REFLECTOR ANTENNA SYSTEM AND TECHNIQUE FOR EQUALIZING SAME

This is a continuation of application Ser. No. 07/946,122, filed Sep. 17, 1992, now abandoned.

BACKGROUND OF THE INVENTION

1. Technical Field

This invention relates generally to antenna reflector systems and, more particularly, to equalized far-field shaped beam radiation patterns for offset fed oppositely located shaped reflectors generally found on a spacecraft and technique for equalizing same.

2. Discussion

Antenna systems frequently employ a shaped reflector to collimate or focus a beam of energy into a selected shaped beam pattern with high radiation efficiency. Currently, a number of spacecraft systems employ first and second offset fed shaped reflectors on opposite sides of the spacecraft. The first and second offset fed shaped reflectors are conventionally known and described herein as east and west shaped reflectors.

An offset fed geometry is usually selected to minimize mechanical structure and deployment mechanisms that would normally be utilized in a center fed configuration. It is generally required that the offset fed geometry be rotated around the central axis of the spacecraft while at the same time providing for substantially equal far-field shaped beam radiation patterns. In addition, spacecraft systems typically impose the requirement that the east and west shaped reflectors provide substantially equal gain performance for all communication channels provided therewith.

Equalized offset fed east and west shaped reflectors located opposite one another on a spacecraft are usually employed to provide additional communication channels. For instance, the east shaped reflector may provide six channels of communication, while the west shaped reflector provides an additional six different channels of communication. As a result, the spacecraft satellite system is able to communicate within a desired geographical area using an increased number of channels, each of which provide substantially equal shaped beam radiation patterns.

Current spacecraft communications systems typically require that the east and west shaped antenna reflector gain performance be equalized to within 0.5 dB over the geographical area illuminated by the mainlobe. In addition, stringent sidelobe requirements are frequently imposed which further requires superior equalization. The aforementioned stringent equalization requirements help prevent degradation of adjacent channel performance due to antenna characteristics.

The conventional east and west offset fed shaped reflector approach generally requires two different shaped reflectors which have reflective surfaces shaped different from one another to provide equalized far-field shaped beam radiation patterns. These different shapes generally result from rotating the offset fed geometry 180 degrees around the central axis of the spacecraft, while the farfield shaped beam radiation patterns remain substantially the same. Currently, a considerable amount of time and expense is spent equalizing the east and west shaped reflector performance. Some conventional equalization techniques have employed sophisticated computer operated programs to obtain substantially equal far-field shaped beam radiation patterns. However, the offset reflector geometry generally increases the difficulty which results in increased design cycle time in achieving an acceptable degree of equality between the east and west shaped reflector designs.

It is therefore desirable to provide for an enhanced technique for equalizing oppositely located offset fed east and west shaped reflectors. In addition, it is desirable to provide for equalized oppositely located offset fed east and west antenna reflectors which may be more easily designed and formed. Furthermore, it is desirable to provide for such east and west antenna reflectors which may be designed in a less expensive and less timely manner.

SUMMARY OF THE INVENTION

In accordance with the teachings of the present invention, equalized offset fed east and west shaped reflectors and a technique for producing the same are provided. A first shaped reflector is formed with a first shaped reflective surface to provide a shaped beam radiation pattern. Dimensional deviations are measured between the first shaped reflective surface and one side of a parent surface. A second shaped reflector is formed with a second shaped reflective surface which has the dimensional deviations superimposed on the opposite side of the parent surface as those of the first shaped reflector. The second shaped reflector is rotated 180 degrees relative to the first shaped reflector. The first and second shaped reflectors are then oppositely located, on a spacecraft for example, in a conventional east and west configuration having far-field shaped beam radiation patterns which are substantially equal to one another.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENT

Figure 1:
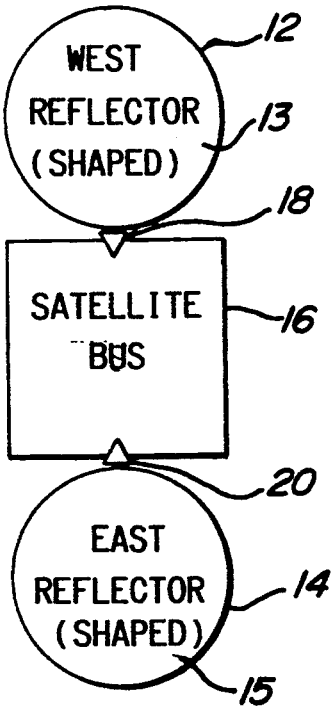
FIG. 1 is a front view of equalized offset fed east and west shaped reflectors oppositely located on a satellite bus in accordance with the present invention.
Figure 2:
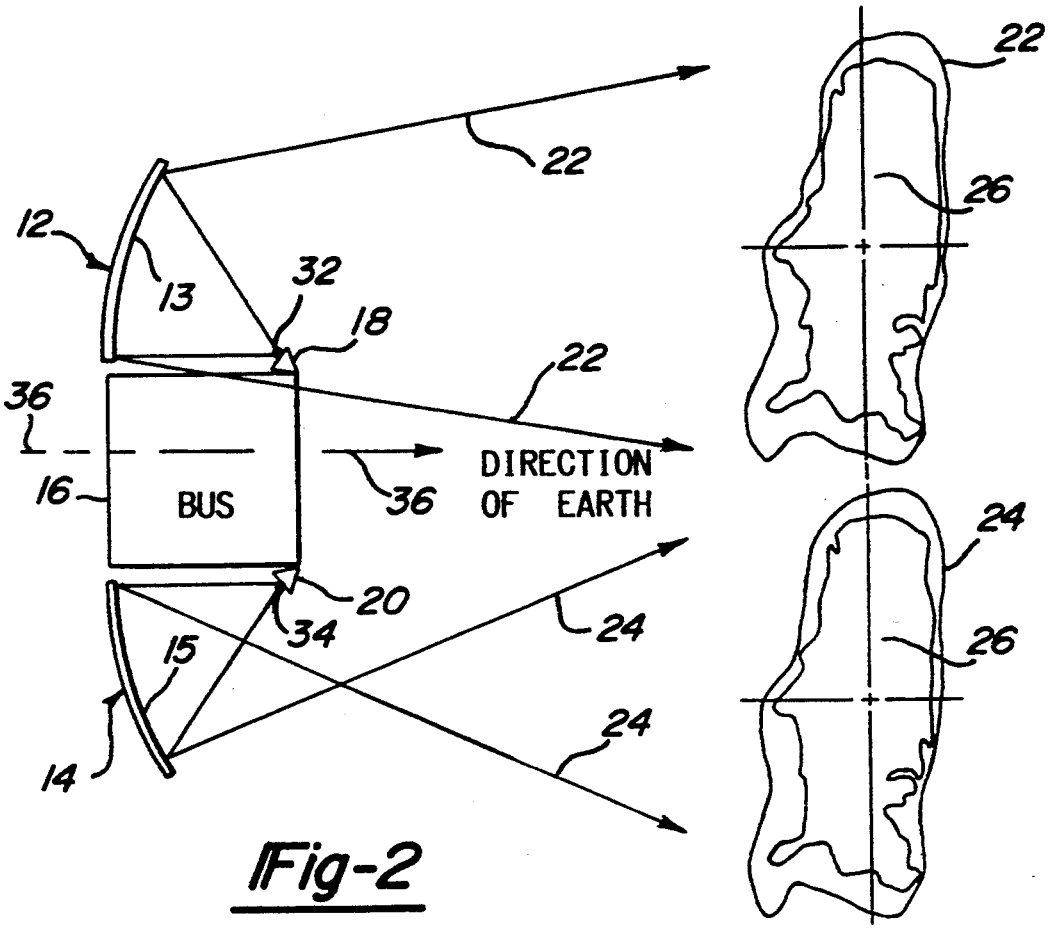
FIG. 2 is a side view of the equalized offset fed shaped reflectors and associated beam radiation patterns in accordance with the present invention.

Referring now to FIGS. 1 and 2, equalized offset fed east and west shaped reflector antenna systems are shown mounted on opposite sides of a satellite bus 16. The west shaped reflector antenna system includes a first (west) shaped reflector 12 and a first feed horn 18 located on the west side of spacecraft bus 16 which is generally found on a spacecraft spacecraft. The east shaped reflector antenna system includes a second (east) shaped reflector 14 and a second feed horn 20 located on the east side of the spacecraft bus 16. While an east and west reflector orientation is described herein, the use of such orientation is merely conventional terminology, as any oppositely located orientation may be employed.

The west shaped reflector 12 has a shaped reflective surface 13 for reflecting energy emanating from feed horn 18 and generating a shaped beam radiation pattern 22. The east shaped reflector 14 has a reflective surface 15 for reflecting energy emanating from feed horn 20 and generating a shaped beam radiation pattern 24. While the west and east shaped reflectors 12 and 13 are shown with diverging and converging reflective surfaces 13 and 15, respectively, any number of shaped surfaces may be employed in accordance with the present invention. The shaped beam radiation patterns 22 and 24 provide substantially identical far-field shaped beam radiation patterns and gain contours. In addition, the reflective surfaces 13 and 15 may likewise receive energy from the shaped beam radiation patterns 22 and 24 and reflect the received energy to the feed horns 18 and 20.

The west and east shaped reflectors 12 and 14 have associated first and second focal points 32 and 34, respectively. Feed horn 18 is mounted to the west side of the spacecraft bus 16 in the vicinity of the first focal point 32 so as to face shaped reflective surface 13. In contrast, feed horn 20 is mounted to the east side of the spacecraft bus 16 in the vicinity of the second focal point 34 so as to face shaped reflective surface 15. The west shaped reflector antenna system is located substantially symmetric to the east shaped reflector antenna system about the central axis of the spacecraft 36. That is, the west and east shaped reflectors 12 and 14 and associated feed horns 18 and 20 are located symmetric to one another about axis 36.

Figure 6:
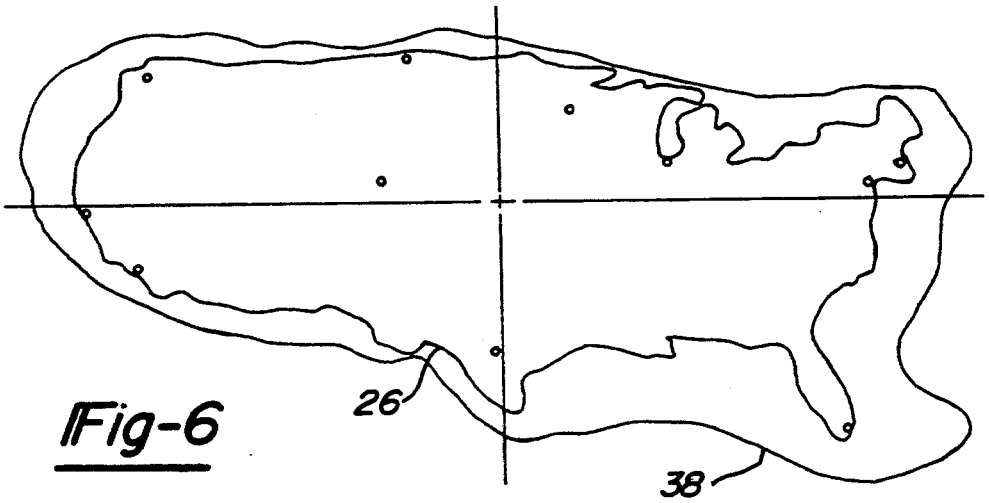
FIG. 6 illustrates an example of a typical farfield shaped beam coverage employed by a spacecraft satellite system.

The west and east shaped reflective surfaces 13 and 15 are shaped so as to transmit and/or receive energy within substantially identical far-field shaped beam patterns. A typical far-field shaped beam pattern 38 employed by spacecraft systems for covering the mainland portion of the United States 26 is illustrated in FIG. 6. In doing so, the west shaped reflective surface 13 may be illuminated by feed horn 18 to provide a shaped beam radiation pattern 22 which may, for example, cover a geographic area such as the United States mainland 26. The east shaped reflective surface 15 may be illuminated by feed horn 20 to provide a shaped beam pattern 24 which likewise covers the same geographic area.

In operation, the west shaped reflector antenna system may be employed to transmit and/or receive a first set of communication channels. The east shaped reflector antenna system may likewise transmit and/or receive a second set of communication channels with substantially the same far-field shaped beam radiation pattern. Adjacent communication channels may be divided between the east and west shaped reflector antenna systems. This enables a spacecraft to provide for a large number of communication channels with low interference, especially between adjacent channels.

Using conventional approaches, east and west shaped reflectors have generally been independently designed separate one from the other. The independent reflector designs usually involve a considerable amount of time and cost in order to provide the necessary equalization therebetween. This invention provides for an improved technique for providing more superior equalized offset fed east and west shaped reflectors 12 and 14 for antenna reflector systems in a less time consuming and less costly manner.

Figure 3:
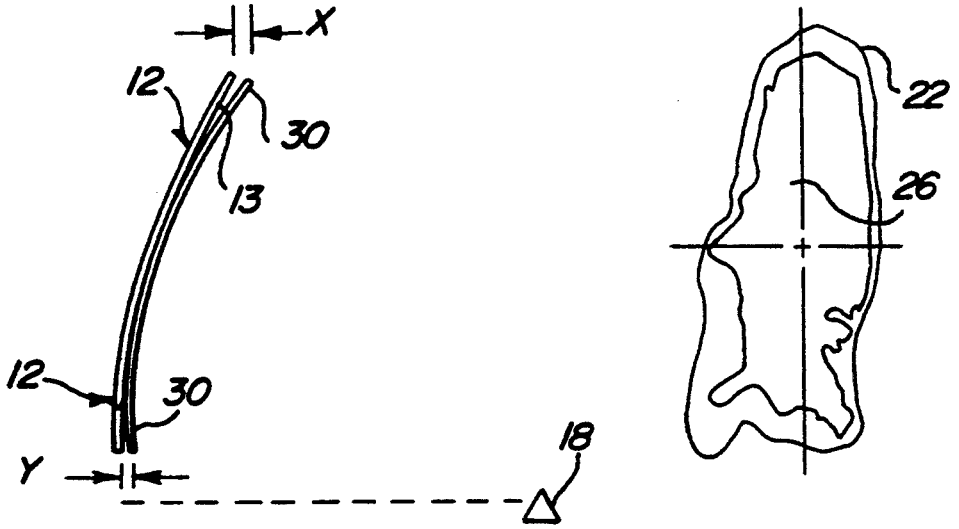
FIG. 3 illustrates a first shaped reflector in comparison to a parent parabolic surface.
Figure 4:
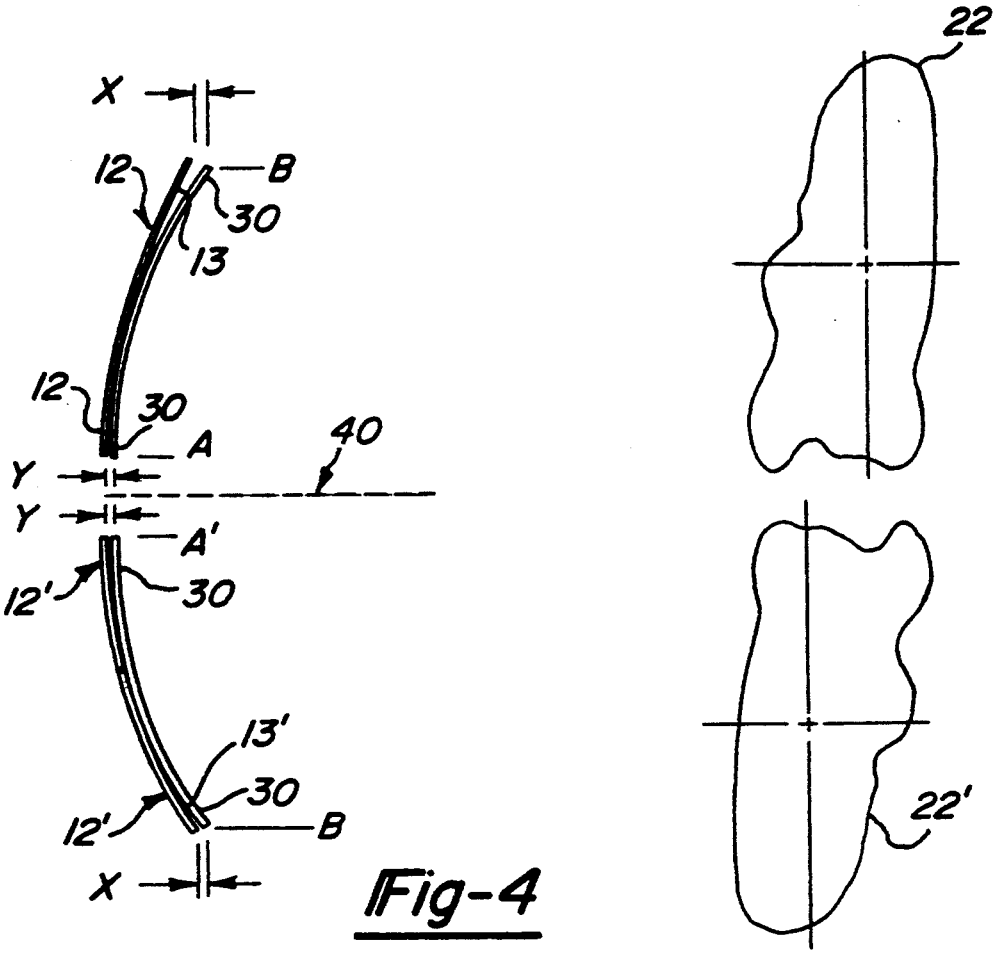
FIG. 4 illustrates the design of a second offset shaped reflector in accordance with the present invention.
Figure 5:
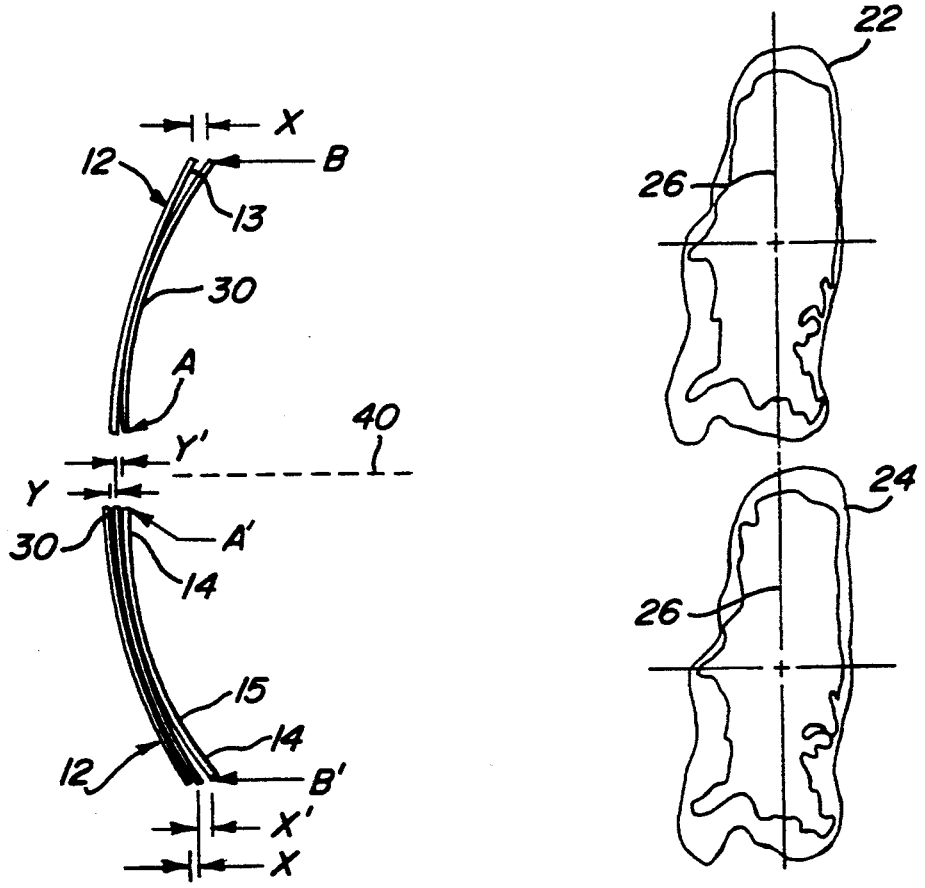
FIG. 5 further illustrates the design of the second offset shaped reflector in accordance with the present invention.

In accordance with the present invention, a technique for providing equalized offset fed east and west shaped reflectors is illustrated in FIGS. 3 through 5. According to this technique, the first shaped reflector 12 is designed and formed having a shaped reflective surface 13 which provides a desired shaped beam radiation pattern 22. FIG. 3 illustrates the west shaped reflector 12 with reflective surface 13 in relation to a parent parabolic surface 30. The shaped reflective surface 13 is generally designed by forming dimensional deviations throughout the surface of a parent surface such as parabolic surface 30. The dimensional deviations may include deviations X and Y measured respectively near the top and bottom edges B and A of west shaped reflector 12. It is generally required that dimensional deviations exist throughout most of the reflective surface 13. The dimensional deviations essentially generate phase error over the surface of the reflector so as to generate the selected shaped beam radiation pattern.

The second shaped reflector 14 is designed with shaped reflective surface 15 in accordance with a transformation as provided herein. For purposes of this description, the design of the east shaped reflective surface 15 will be described by way of a transformation of the west shaped reflective surface 13. The dimensional deviations such as deviations X and Y between the west shaped reflective surface 13 and the parent parabolic surface 30 are measured throughout the entire surface of the west shaped reflective surface 13. While a parabolic parent surface is shown in FIGS. 3–5 and described herein in accordance with a preferred embodiment, other shapes of parent surfaces may be employed in accordance with the present invention, For instance, the parent surface may include a hyperbolic surface or flat mirrored surface.

The first step in the transformation leading to the design of the east shaped reflector 14 with reflective surface 15 is further illustrated in FIG. 4. As shown, the west shaped reflective surface 13 is superimposed on the opposite side of the focal axis 40 of parent parabolic surface 30. In doing so, the dimensional deviations X and Y are rotated 180 degrees so that the bottom edge A of the west shaped reflective surface 13 is adjacent to the top edge A′ of the superimposed shaped reflective surface 13′. This orientation results in the west shaped reflective surface 13 and superimposed shaped reflective surface 13′ being located symmetric to one another about focal axis 40. As a consequence of the first step in the transformation, the shaped beam pattern 22 produced by reflective surface 13 and shaped beam pattern 22′ produced by reflective surface 13′ are rotated relative to each other.

The second step in the transformation leading to the east shaped reflective surface 15 is illustrated in FIG. 5. As shown, dimensional deviations such as X′ and Y′ which are equal in magnitude to dimensions X and Y, respectively, are formed onto the other side of the parent parabolic surface. That is, while deviations such as X and Y are measured with west shaped reflective surface 13 on the front side of the parent surface 30, the east shaped reflector 14 is formed with reflective surface 15 on the opposite or rear side of the parent parabolic surface 30. As a consequence of the second step in the transformation, the shaped beam pattern 22' is rotated to thereby produce shaped beam pattern 24 which is substantially equal to shaped beam pattern 22 produced by reflective surface 13. The shaped beam radiation patterns 22 and 24 provide a substantially equal far-field shaped beam coverage 38, such as that shown in FIG. 6, for covering the mainland portion of the United States 26. This technique could likewise be used by starting with the east shaped reflective surface 15 and applying the transformation described herein to produce the west shaped reflective surface 13. In addition, any number of desired beam patterns may be selected in accordance with this invention.

Figure 7:
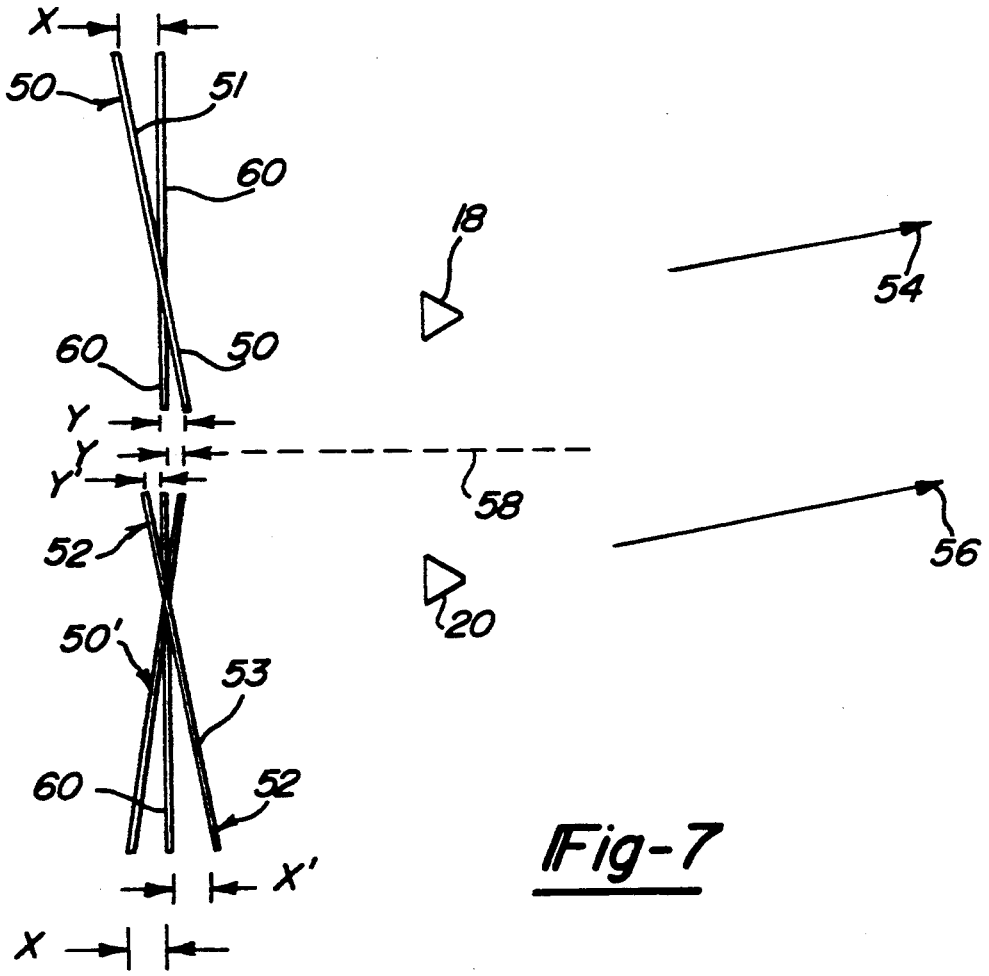
FIG. 7 illustrates the design of equalized offset fed east and west shaped reflectors which have flat surfaces in accordance with an alternate embodiment of the present invention.

The aforementioned technique has been described in relation to a parent parabolic surface 30, however, the present invention may employ any number of parent surfaces in a variety of shapes which may include a hyperbolic surface, flat mirrored surface, ellipsoidal surface amongst other possible shapes. In accordance with an alternate embodiment, the present invention is further illustrated in FIG. 7 which shows a pair of flat reflective surfaces in relation to a flat parent surface 60. A flat mirror reflector 50 which has a flat reflective surface 51 is shown in relation to the flat parent surface 60 with dimensional deviations such as deviations X and Y provided therebetween. According to the present invention, the flat reflective surface 50 is superimposed on the other side of axis 58, rotated 180 degrees and formed with the dimensional deviations X' and Y' formed on the opposite side of the parent surface 60. As a result, a second flat reflector 52 having a flat reflective surface 53 is formed. The flat reflective surfaces 51 and 53 are operatively coupled to respective feed horns 18 and 20 to provide equalized far-field beam radiation patterns 54 and 56.

While the present invention has been employed in accordance with first and second shaped reflectors 12 and 14, it is conceivable that one could .employ the present invention in combination with dual reflector systems such as cassegrain antenna systems. It is further conceivable that such a use could include any number of subreflectors. In addition, the present invention may further be employed with any number of feed horns located in the vicinity of focal points 32 and 34.

In view of the foregoing, it can be appreciated that the present invention enables the user to achieve an improved technique for providing equalized offset fed east and west shaped reflectors. Thus, while this invention has been disclosed herein in combination with a particular example thereof, no limitation is intended thereby except as defined in the following claims. This is because a skilled practitioner will recognize that other modifications can be made without departing from the spirit of this invention after studying the specification and drawings.

What is claimed is:

1. A method for forming a second shaped reflector having far field beam characteristics substantially equal and opposite to a first shaped reflector, the first shaped reflector having dimensional deviations with respect to a first side of a substantially symmetrical parent surface, the method comprising:

superimposing the first shaped reflector onto the first side of the parent surface;

rotating the first shaped reflector 180° with respect to the parent surface;

measuring dimensional deviations between the first shaped reflector as superimposed and rotated and the first side of the parent surface;

projecting the measured dimensional deviations onto a second side of the parent surface, the second side being opposite the first side;

forming the second shaped reflector with reference to the parent surface by applying the projected measured dimensional deviations.

2. The method as defined in claim 1 wherein the parent surface comprises a parabolic surface.

3. The method as defined in claim 1 wherein the parent surface comprises a flat surface.

4. The method as defined in claim 1 wherein the first and second shaped reflectors comprise reflectors for reflecting radiation from offset feed horns in a spacecraft antenna system.

5. The method as defined in claim 1 wherein the first and second shaped reflectors are adapted for mounting on opposite sides of a spacecraft body in an equalized offset fed spacecraft communications antenna system.

6. A method for forming a second shaped electromagnetic radiation reflector for use in a spacecraft communications antenna system having far field electromagnetic radiation beam characteristics substantially equal and opposite to a first shaped spacecraft communications antenna system reflector, the first shaped reflector having dimensional deviations with respect to a first side of a substantially symmetrical parent surface and having a radiation pattern defined with respect to one side of a focal axis, the method comprising:

superimposing tile first shaped reflector onto the first side of the parent surface on the opposite side of the focal axis;

rotating the first shaped reflector 180° with respect to the parent surface;

measuring dimensional deviations between the first shaped reflector as superimposed and rotated and the first side of the parent surface;

projecting the measured dimensional deviations onto a second side of the parent surface, the second side being opposite the first side;

forming the second shaped reflector with reference to the parent surface by applying the projected measured dimensional deviations.

7. The method as defined in claim 6 wherein the parent surface comprises a parabolic surface.

8. The method as defined in claim 6 wherein the parent surface comprises a flat surface.

9. The method as defined in claim 6 wherein the first and second shaped reflectors comprise reflectors for reflecting radiation from offset feed horns in a spacecraft antenna system.

10. The method as defined in claim 6 wherein the first and second shaped reflectors are adapted for mounting on opposite sides of a spacecraft body in an equalized offset fed spacecraft communications antenna system.

* * * * *